US005873060A

United States Patent [19]

Ozawa

[11] Patent Number: 5,873,060

[45] Date of Patent: Feb. 16, 1999

[54] SIGNAL CODER FOR WIDE-BAND SIGNALS

[75] Inventor: Kazunori Ozawa, Tokyo, Japan

[73] Assignee: NEC Corporation, Japan

[21] Appl. No.: 863,785

[22] Filed: May 27, 1997

[30] Foreign Application Priority Data

May 27, 1996 [JP] Japan ..... 8-154850

[51] Int. Cl.[6] ..... G10L 7/02

[52] U.S. Cl. ..... 704/230; 704/221; 704/222; 704/223; 704/219; 704/220

[58] Field of Search ..... 704/230, 229, 704/228, 222, 221, 223, 220, 219

[56] References Cited

U.S. PATENT DOCUMENTS

| | | | |
|---|---|---|---|
| 4,945,565 | 7/1990 | Ozawa et al. | 704/223 |
| 5,142,584 | 8/1992 | Ozawa | 704/223 |
| 5,208,862 | 5/1993 | Ozawa | 704/216 |
| 5,295,224 | 3/1994 | Makamura et al. | 704/223 |
| 5,487,128 | 1/1996 | Ozawa | 704/222 |
| 5,625,744 | 4/1997 | Ozawa | 704/222 |

FOREIGN PATENT DOCUMENTS

| | | |
|---|---|---|
| 607989 | 7/1994 | European Pat. Off. . |
| 4-171500 | 6/1992 | Japan . |
| 4-363000 | 12/1992 | Japan . |
| 4363000 | 12/1992 | Japan . |
| 5-6199 | 1/1993 | Japan . |

OTHER PUBLICATIONS

C. Garcia–Mateo, et al., "Application of a Low–Delay Bank of Filters to Speech Coding", 1994 Sixth IEEE Digital Signal Processing Workshop, Proceedings of IEEE 6th Digital Signal Processing Workshop, Oct. 1–5, 1994, pp. 219–222.

G. Yang, "Multiband code–excited linear prediction (MBCELP) for speech coding", Signal Processing European Journal Devoted to the Methods and Applications of Signal Processing, vol. 31, No. 2, Mar. 1, 1993, pp. 215–227.

Nakamizo, "Signal Analysis and System Identification", publicshed by Corona Co., Ltd., 1988 pp. 82–87.

Sugamura, et al., "Speech Data Compression by Linear Spectrum Pair (LSP) Speech Analyzing/Synthesizing System", *Transactions of the Japan Society of Electronic Communication,* J64–A, pp. 599–605, 1981.

*ICASSP 85 Proceedings,* vol. 3 of 4, Mar. 1985, "Code–Excited Linear Prediction (CELP): High–Quality Speech At Very Low Bit Rates", by Manfred R. Schroeder, pp. 937–940.

*ICASSP 88,* vol. 1, 1988, "Improved Speech Quality And Efficient Vector Quantization In Selp", by W.B. Kleijn et al., pp. 155–158.

*ICASSP 91,* vol. 1, May 1991, "16 KBPS Wideband Speech Coding Technique Based On Algebraic Celp" by C. Laflamme et al., pp. 13–16.

(List continued on next page.)

*Primary Examiner*—David R. Hudspeth
*Assistant Examiner*—Susan Wieland
*Attorney, Agent, or Firm*—Ostrolenk, Faber, Gerb & Soffen, LLP

[57] ABSTRACT

Wide-band speech signals and also music signals are coded with relatively less computational efforts and less sound quality deterioration even at low bit rates. A spectral parameter calculator obtains a spectral parameter from sub-frames of an input signal from a sub-frame divider, and quantizes the obtained spectral parameter. A divider divides the difference result from a subcontractor into a plurality of sub-bands. Adaptive codebook circuits obtain a pitch prediction signal by obtaining pitch data in at least one of the sub-bands. Judging circuits execute pitch prediction judgment by using the pitch data in at least one of the sub-bands. A synthesizer synthesizes a pitch prediction signal. A subtractor subtracts the pitch prediction signal from the difference result obtained from a subtractor and thus obtains an excitation signal. An excitation quantizer quantizes the excitation signal with reference to an excitation codebook.

8 Claims, 9 Drawing Sheets

OTHER PUBLICATIONS

*Proceedings of the IEEE,* vol. 78, No. 1, Jan. 1990, "Multirate Digital Filters, Filter Banks, Polyphase Networks, and Applications: A Tutorial" by P.P. Vaidyanathan, pp. 56–93.

*ICASSP 90,* vol. 2, Apr. 1990, "Pitch Predictors With High Temporal Resolution", by Peter Kroon et al., pp. 661–664.

*IEEE Transactions on Communications,* vol. COM–28, No. 1, Jan. 1980, "An Algorithm for Vector Quantizer Design" by Yoseph Linde et al., pp. 84–95.

SIGNAL CODER FOR WIDE-BAND SIGNALS

BACKGROUND OF THE INVENTION

1. Field of the Invention

The present invention relates to a signal coder and, more particularly, to a signal coder for high quality coding of wide-band signals such as speech and music at low bit rates.

2. Description of the Related Art

As a system for highly efficiently coding speech signals, CELP (Code Excited Linear Prediction Coding) is well known in the art, as disclosed in, for instance, M. Schroeder and B. Atal, "Code-excited linear prediction: High quality speech at very low bit rates", Proc. ICASSP, pp. 937–940, 1985 (Literature 1), and Kleijn et al, "Improved speech quality and efficient vector quantization in CELP", Proc. ICASSP, pp. 155–158, 1998 (Literature 2).

In these well-known systems, on the transmitting side spectral parameters representing a spectral characteristic of a speech signal are extracted from the speech signal for each frame (of 20 ms, for instance) through LPC (linear prediction). Also, the frame is divided into sub-frames (of 5 ms, for instance), and parameters in an adaptive codebook (i.e., a delay parameter corresponding to the pitch cycle and a gain parameter) are extracted for each sub-frame on the basis of the past speech signals, for making the pitch prediction of the sub-frame noted above with the adaptive codebook. The optimum gain is calculated by selecting an optimum speech codevector from the excitation codebook (i.e., vector quantization codebook) consisting of noise signals of predetermined kinds for the speech signal obtained by the pitch prediction. Thus the excitation signal is quantized. An excitation codevector is selected which minimizes the error power between a synthesized signal from selected noise signals and an excitation signal obtained by the pitch prediction. An index representing the kind of the selected codevector, an index representing a gain codevector, the spectral parameter, a delay parameter corresponding to the pitch cycle and a gain parameter are combined in a multiplexer and then transmitted.

The above prior art systems have a problem that a great computational effort is required for the optimum speech codevector selection. This is attributable to the facts that in the systems disclosed in Literatures 1 and 2 the filtering or convolution is executed for each codevector, and that this computational operation is executed repeatedly a number of times corresponding to the number of codevectors stored in the codebook. For example, with a codebook of B bits and N dimensions, the computational effort required is $N \times K \times 2B \times 8{,}000/N$ (K being the filter order or impulse response length in the filtering or convolution). As an example, when B=10, N=40 and K=10, 81,920,000 computations per second are necessary, which is very enormous. This problem is increasingly more serious the more the input signal band is higher than the telephone band and the higher the sampling frequency.

Various systems have been proposed to reduce the computational effort required for the excitation codebook search. For example, an ACELP (Algebraic Code Excited Linear Prediction) has been proposed. For this system, C. Laflamme et al, "16 kbps wideband speech coding technique based on algebraic CELP", Proc. ICASSP, pp. 13–16, 1991 (Literature 3), for instance, may be referred to. In the system shown in Literature 3, an excitation signal is represented by a plurality of pulses, and the position of each pulse for transmission is represented by a predetermined number of bits. The amplitude of each pulse is limited to +1.0 or −1.0, and it is thus possible to greatly reduce the computational effort for the pulse search.

Any of the techniques described above permits obtaining comparatively good sound quality with speech signals. However, with speech signals of a plurality of speakers speaking in a conference or the like or music signals produced by a plurality of different musical instruments and containing a plurality of different pitches, low bit rates result in extreme sound quality deterioration.

SUMMARY OF THE INVENTION

An object of the present invention is therefore to solve the above problems and provide a signal coder, in which even at a low bit rate the necessary computational effort and sound quality deterioration are relatively less with wide-band speech signals as well as music signals.

According to an aspect of the present invention, there is provided a signal coder comprising: a spectral parameter calculator for obtaining a spectral parameter from an input signal and quantizing the spectral parameter thus obtained; a divider for dividing the input signal into a plurality of sub-bands; a pitch calculator for obtaining pitch data in at least one of the sub-bands and obtaining a pitch prediction signal; a judging unit for obtaining pitch prediction signal in at least one of the sub-bands and executing pitch prediction judgment; and an excitation quantizer for synthesizing the pitch prediction signal, subtracting the obtained pitch prediction signal from the input signal to obtain an excitation signal, and quantizing the obtained excitation signal.

According to another aspect of the present invention, there is provided a signal coder comprising: a spectral parameter calculator for obtaining a spectral parameter from an input signal and quantizing the spectral parameter thus obtained; a mode judging unit for judging the mode of the input signal by extracting a feature quantity therefrom; a divider for dividing the input signal into a plurality of sub-bands in a predetermined mode; a pitch calculator for obtaining pitch data in at least one of the sub-bands and obtaining a pitch prediction signal; a judging unit for making pitch prediction judgment using the pitch prediction signal in at least one of the sub-bands; and an excitation quantizer operable in a predetermined mode to synthesize the pitch prediction signal, obtaining an excitation signal by subtracting the synthesized pitch prediction signal from the input signal, and quantizing the excitation signal thus obtained.

The excitation signal of the input signal is quantized by expressing it as a plurality of non-zero amplitude pulses.

According to other aspect of the present invention, there is provided a signal coder comprising: a spectral parameter calculator for obtaining a spectral parameter from an input signal and quantizing the spectral parameter thus obtained; a divider for dividing the input signal into a plurality of sub-bands; a pitch calculator for obtaining a plurality of pitch data candidates in at least one of the sub-bands and obtaining a pitch prediction signal for each pitch data candidate; a selector for synthesizing the pitch prediction signal for a combination of pitch data candidates and selecting the best pitch data by using the error signal between the input signal and the pitch prediction signal; and an excitation quantizer for quantizing the error signal.

According to still other aspect of the present invention, there is provided a signal coder comprising: a spectral parameter calculator for obtaining a spectral parameter from an input signal and quantizing the spectral parameter thus obtained; a mode judging unit for judging the mode of the input signal by extracting a feature quantity therefrom; a divider for dividing the input signal into a plurality of sub-bands in a predetermined mode; a pitch calculator for obtaining a plurality of pitch data candidates in at least one of the sub-bands and obtaining a pitch prediction signal for each pitch data candidate; a selector operable in a predetermined mode to synthesize the pitch prediction signal for a combination of pitch data candidates and selecting the best pitch data by using the error signal between the input signal and the pitch prediction signal; and an excitation quantizer for quantizing the error signal.

The error signal is quantized by expressing it using a plurality of non-zero amplitude pulses.

Other objects and features will be clarified from the following description with reference to attached drawings.

PREFERRED EMBODIMENTS OF THE INVENTION

Figure 1:
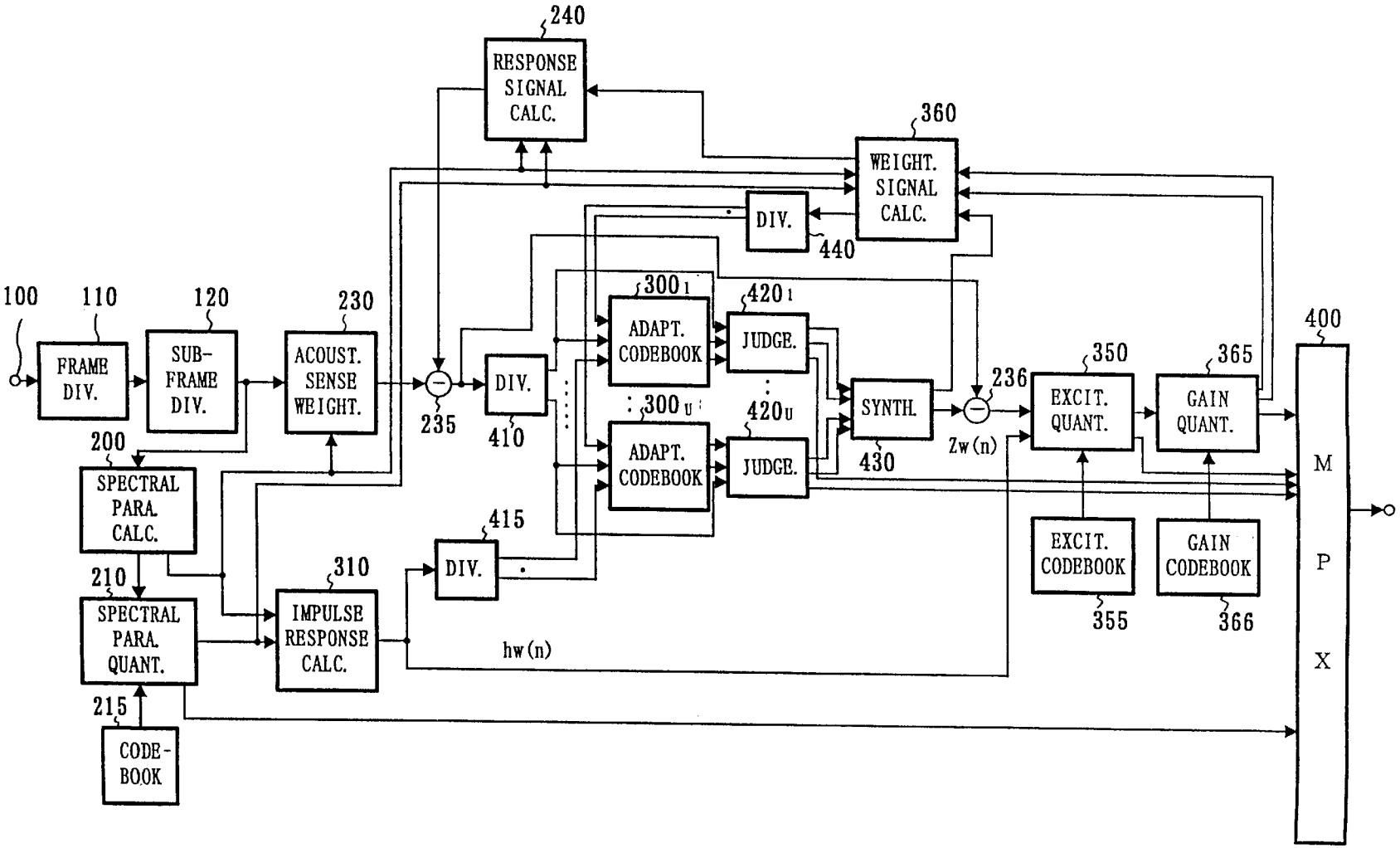
FIG. 1 is a block diagram showing a first embodiment of the signal coder according to the present invention.

FIG. 1 is a block diagram showing a first embodiment of the signal coder according to the present invention. This embodiment of the signal coder comprises a frame divider 110, a sub-frame divider 120, a spectral parameter calculator 200, a spectral parameter quantizer 210, a codebook 215, an acoustical sense weighting circuit 230, subtractors 235 and 236, a response signal calculator 240, adaptive codebook circuits $\mathbf{300}_1$ to $\mathbf{300}_U$, an impulse response calculator 310, an excitation quantizer 350, an excitation codebook 355, a gain quantizer 365, a gain codebook 366, a multiplexer 400, dividers 410, 415 and 440, judging circuits $\mathbf{420}_1$ to $\mathbf{420}_U$ for executing the pitch prediction judgment, and a synthesizer 430.

The operation of the first embodiment of the signal coder having the above construction will now be described.

The frame divider 110 divides a speech signal supplied from an input terminal 100 into frames (of 10 ms, for instance).

The sub-frame divider 120 divides the speech signal frame into sub-frames (of 5 ms, for instance) shorter than the frame.

The spectral parameter calculator 200 calculates a spectral parameter of a predetermined degree (for instance, (P=10)th degree) by taking out the speech with a window longer than the sub-frame (for instance 24 ms) provided with respect to at least one sub-frame speech signal. The spectral parameter may be calculated by using the well-known LPC analysis, Burg analysis, etc. It is herein assumed that the Burg analysis is used. The Burg analysis is detailed in Nakamizo, "Signal Analysis and System Identification", published by Corona Co., Ltd., 1988, pp. 82–87 (Literature 4), and is not described here.

The spectral parameter calculator 200 also converts a linear prediction coefficient $\alpha i$ (i=1, . . . ,10) calculated in the Burg method into an LSP parameter suited for quantization or interpolation. For the conversion of the linear prediction coefficient to the LSP parameter, reference may be had to Sugamura et al, "Speech Data Compression by Linear Spectrum Pair (LSP) Speech Analyzing/Synthesizing System", Transactions of the Japan Society of Electronic Communication, J64-A, pp. 599–605, 1981 (Literature 5). For example, the spectral parameter calculator 200 converts a linear prediction coefficient obtained in the 2-nd sub-frame by the Burg method into an LSP parameter, obtains a 1-st sub-frame LSP parameter through the linear interpolation, inversely converts the 1-st sub-frame LSP parameter to restore a linear prediction coefficient, and outputs a 1-st and a 2-nd sub-frame linear prediction coefficients $\alpha_{il}$ (i=1, . . . ,10, l=1,2) to the acoustical sense weighting circuit 230. The spectral parameter calculator 200 further outputs the 2-nd sub-frame LSP parameter to the spectral parameter quantizer 210.

The spectral parameter quantizer 210 efficiently quantizes the LSP parameter of a predetermined sub-frame. Specifically, the 2-nd sub-frame LSP parameter is vector quantized. This vector quantization may be executed by well-known methods. For specific methods of the vector quantization, reference may be had to, for instance, Japanese Laid-Open Patent Publication No. 4-171500 (Literature 6), Japanese Laid-Open Patent Publication No. 4-363000 (Literature 7), Japanese Laid-Open Patent Publication No. 5-6199 (Literature 8), and T. Nomura et al, "LSP Coding Using VQ-SVQ With Interpolation in 4.074 kbps M-LCELP Speech Coder", Proc. Mobile Multimedia Communications, pp. B. 2.5, 1993 (Literature 9).

The spectral parameter quantizer 210 selects and outputs a codevector which minimizes the distortion $D_j$ given by Equation (1).

Equation (1):

$$D_j = \sum_{i}^{P} W(i)[LSP(i) - QLSP(i)_j]^2$$

In Equation (1), LSP(i), $QLSP(i)_j$ and W(i) are the LSP of the i-th sub-frame, the j-th codevector and the weighting coefficient, respectively, before the quantization.

The spectral parameter quantizer 210 restores the 1-st sub-frame LSP parameter from the LSP parameter which has been quantized in the 2-nd sub-frame. Specifically, the spectral parameter quantizer 210 restores the 1-st sub-frame LSP parameter through the linear interpolation of the quantized LSP parameter of the 2-nd sub-frame of the current frame and the quantized LSP parameter of the 2-nd sub-frame of the immediately preceding frame. The spectral parameter quantizer 210 can restore the 1-st sub-frame LSP parameter through the linear interpolation after selecting a codevector which minimizes the error power between the LSP parameter before the quantization and that after the quantization.

The spectral parameter quantizer 210 converts the restored 1-st sub-frame LSP parameter and the quantized parameter of the 2-nd sub-frame to the linear prediction coefficients $\alpha_i$ (i=1, . . . ,10) for each sub-frame, and outputs the linear prediction coefficients to the impulse response calculator 310. The spectral parameter quantizer 210 further outputs an index, which represents the codevector of the quantized LSP parameter of the 2-nd sub-frame, to the multiplexer 400.

The acoustical sense weighting circuit 230 receives the linear prediction coefficients $\alpha_i$ (i=1, . . . ,10) before the quantization for each sub-frame from the spectral parameter calculator 200, acoustical sense weights the sub-frame speech signal according to Literature 1 noted above, and outputs an acoustical sense weighted signal $x_z(n)$.

The response signal calculator 240 receives the linear prediction coefficient $\alpha_i$ for each sub-frame from the spectral parameter calculator 200 and also the linear prediction coefficient $\alpha_i$ having been restored through the quantization and interpolation for each sub-frame from the spectral parameter quantizer 210, calculates the response signal $x_z(n)$ with an input signal d(n) of zero for one sub-frame by using a value preserved in the filter memory, and outputs the calculated response signal to the subtractor 235. The response signal $x_z(n)$ is represented by Equation (2).

Equation (2):

$$x_z(n) = d(n) - \sum_{i=1}^{P} \alpha_i d(n-i) + \sum_{i=1}^{P} \alpha_i\gamma^i y(n-i) + \sum_{i=1}^{P} \alpha'_i\gamma^i x_z(n-i)$$

When n−i<0, Equations (3) and (4) are provided:

Equation (3):

$$y(n-i)=p(N+(n-i))$$

Equation (4):

$$x_z(n-i)=s_w(N+(n-i))$$

In Equations (2) to (4), N represents the sub-frame length, γ is a weighting coefficient for controlling the amount of the acoustical sense weighting and has the same value as in Equation (6) given below, and $s_w(n)$ and p(n) are a response signal outputted from the weighting signal calculator 360 and an output signal in the right side first term of Equation (6) to be given below as a filter divider term, respectively.

The subtractor 235 subtracts the response signal $x_z(n)$ from the acoustical sense weighting signal $x_z(n)$ for one sub-frame as in Equation (5), and outputs the subtracted result $x'_w(n)$ to the divider 410 and the subtractor 820.

Equation (5):

$$x'_w(n)=x_w(n)-x_z(n)$$

The impulse response calculator 310 calculates the impulse response $h_w(n)$ of the acoustical sense weighting filter, the z transform of which is represented by Equation (6), for a predetermined number L of points, and outputs the calculation result to the divider 415 and the excitation quantizer 350.

Equation (6):

$$h_w(z) = \frac{1 - \sum_{i=1}^{P} \alpha_i z^{-i}}{1 - \sum_{i=1}^{P} \alpha_i\gamma^i z^{-i}} \quad \frac{1}{1 - \sum_{i=1}^{P} \alpha'_i\gamma^i z^{-i}}$$

The divider 410 divides the subtracted result $x'_w(n)$ from the subtractor 235 into a predetermined number U of sub-bands, and outputs these sub-bands as residue signals $x'^{w1}(n)$ to $x'_{wU}(n)$ to the adaptive codebook circuits $\mathbf{300}_1$ to $\mathbf{300}_U$ and the judging circuits $\mathbf{420}_1$ to $\mathbf{420}_U$. The band division may be executed by using a QMF (Quadrature Mirror Filter). The use of the QMF permits band division with a relatively small filter degree. For the constitution of the QMF, reference may be had to P. Vaidyanathan, "Multirate digital filters, filter banks, polyphase networks, and applications: A tutorial", Proc. IEEE, Vol. 78, pp. 56–93, 1990 (Literature 10).

The divider 415 divides the impulse response $h_w(n)$ into a predetermined number U of sub-bands, and outputs these sub-bands as corresponding impulse responses $h_{w1}(n)$ to $h_{wU}(n)$ to corresponding sub-bands of the adaptive codebook circuits $\mathbf{300}_1$ to $\mathbf{300}_U$.

The adaptive codebook circuits $\mathbf{300}_1$ to $\mathbf{300}_U$ and the judging circuits $\mathbf{420}_1$ to $\mathbf{420}_U$ are operative in the same way with respect to each sub-band, and as an example the operations of the adaptive codebook circuit $\mathbf{300}_1$ and the judging circuit $\mathbf{420}_1$ will be described.

The adaptive codebook circuit $\mathbf{300}_1$ receives the past excitation signal $v_1(n)$ corresponding to a sub-band 1 from the divider 440, the residue signal $x'_{w1}(n)$ corresponding to the sub-band 1 from the divider 410, and the impulse response signal $h_{w1}(n)$ corresponding to the sub-band 1 from the divider 415.

The adaptive codebook circuit $\mathbf{300}_1$ derives a delay parameter $T_1$, corresponding to the pitch gain, and a pitch gain $\beta_1$, so as to minimize the distortion $D_{T1}$ in Equation (7), and outputs the obtained data to the judging circuit $\mathbf{420}_1$.

Equation (7):

$$D_{T1} = \sum_{n=0}^{N-1} x'^2_{w1}(n) - \left[\sum_{n=0}^{N-1} x'_{w1}(n)y_{w1}(n-T_1)\right]^2 / \left[\sum_{n=0}^{N-1} y^2_{w1}(n-T_1)\right]$$

In Equation (7), $y_{w1}(n-T_1)$ is given by Equation (8), and the symbol * represents convolution.

Equation (8):

$$y_{w1}(n-T_1)=v_1(n-T_1)*h_{w1}(n)$$

The adaptive codebook circuit $\mathbf{300}_1$ then derives the pitch gain $\beta_1$ as in Equation (9).

Equation (9):

$$\beta_1 = \sum_{n=0}^{N-1} x'_{w1}(n)y_{w1}(n-T) / \sum_{n=0}^{N-1} y^2_{w1}(n-T_1)$$

In Equation (9), the delay parameter $T_1$ may be obtained not as an integer sample but as a decimal sample in order to improve the accuracy of extraction of the delay parameter $T_1$ for speech of women and children. For a specific method, reference may be had to, for instance, P. Kroon et al, "Pitch predictors with high temporal resolution", Proc. ICASSP, pp. 661–664, 1990 (Literature 11).

The adaptive codebook circuit $\mathbf{300}_1$ quantizes the pitch gain $\beta_1$ with a predetermined quantizing bit number, then executes the pitch prediction as in Equations (10) and (11), and outputs the pitch prediction signal $q_{w1}(n)$ and the pitch prediction excitation signal $g_1(n)$ to the judging circuit $\mathbf{420}_1$.

Equation (10):

$$q_{w1}(n)=\beta'_1 v_1(n-T_1)*h_{w1}(n)$$

Equation (11):

$$g_1(n)=\beta'_1 v_1(n-T_1)$$

In Equations (10) and (11), $\beta'_1$ is the quantized gain.

The judging circuit $\mathbf{420}_1$ derives the pitch prediction gain $G_1$ and executes the judgment as to whether or not to execute the pitch prediction by comparing the derived pitch prediction gain $G_1$ with a predetermined pitch prediction gain. The pitch prediction gain $G_1$ is derived as in Equation (12).

Equation (12):

$$G_1 = 10\log_{10}\frac{\sum_{n=0}^{N-1} x_{w1}'(n)^2}{\sum_{n=0}^{N-1}[x_{w1}'(n) - q_{w1}(n)]^2}, \text{(dB)}$$

When the pitch prediction gain $G_1$ is greater than a predetermined threshold value, the judging circuit $\mathbf{420}_1$ judges that pitch prediction is activated, and outputs the pitch prediction signal $q_{w1}(n)$ and the pitch prediction excitation signal $g_1(n)$ to the synthesizer 430.

When the pitch prediction gain $G_1$ is less than the threshold value, the judging circuit $\mathbf{420}_1$ judges that the pitch prediction is not activated, and outputs zero amplitude signal to the synthesizer 430.

When the pitch prediction is activated, the judging circuit $\mathbf{420}_1$ outputs an index representing the delay parameter $T_1$ and an index representing the quantized gain $\beta'_1$ to the multiplexer 400.

The synthesizer 430 receives the pitch prediction signal $q_{w1}(n)$ and the pitch prediction excitation signal $g_1(n)$ from the judging circuit $\mathbf{420}_1$, executes full band synthesis, and outputs the full band synthesized signal $q_w(n)$ to the subtractor 236. The synthesizer 430 outputs the full band synthesized excitation signal g(n) to the weighting signal calculator 360.

The subtractor 236 subtracts the full band synthesized signal $g_w(n)$ from the subtracted result $X'_w(n)$ from the subtractor 235, and outputs the result of the subtraction as the excitation signal $z_w(n)$ to the excitation quantizer 350.

Equation (13):

$$z_w(n)=x'_w(n)-q_w(n)$$

The excitation quantizer 350 executes the vector quantization of the excitation signal $z_w(n)$ using the excitation codebook 355. Specifically, the excitation quantizer 350 retrieves from the excitation codebook 355 the excitation codevector $c_j(n)$ such as to minimize the distortion $D_j$ in Equation (14) by using the excitation signal $z_w(n)$ as the output of the subtractor 230 and the impulse response $h_w(n)$ as the output of the impulse response calculator 310.

Equation (14):

$$D_j = \sum_{n=0}^{N-1} z_w(n)^2 - \frac{\left[\sum_{n=0}^{N-1}\phi(n)c_j(n)\right]^2}{\sum_{n=0}^{N-1} s_{wj}(n)^2}$$

In Equation (14), $\phi(n)$ and $s_{wj}(n)$ are given by Equations (15) and (16), respectively.

Equation (15):

$$\phi(n) = \sum_{i=n}^{N-1} z_w(i)h_w(i-n), \quad n = 0, \ldots, N-1$$

Equation (16):

$$s_{wj}(n)=c_j(n)*h_w(n)$$

In Equation (16), symbol * represents convolution.

The excitation quantizer 350 outputs the index representing the selected excitation codevector to the multiplexer 400.

The gain quantizer 365 selects a gain codevector which minimizes the distortion $D_t$ in Equation (17) with respect to the selected excitation codevector by reading out the gain codevectors from the gain codebook 366. In this example, the excitation codevector gain is vector quantized.

Equation (17):

$$D_t = \sum_{n=0}^{N-1}[z_w(n) - G'_t s_{wj}(n)]^2$$

In Equation (17), $G'_t$ is a t-th codevector element of a gain codevector stored in the gain codevector 366.

The gain quantizer 365 outputs an index representing the selected the gain codevector to the multiplexer 400.

The weighting signal calculator 360 receives an index representing the pitch cycle, an index representing the quantized gain, an index of the excitation codebook 355, and an index representing the gain codebook, reads out a codevector corresponding to these read-out indexes, and derives a drive excitation signal v(n) as in Equation (18).

Equation (18):

$$v(n)=g(n)+G'_t c_j(n)$$

The weighting signal calculator 360 outputs the drive excitation signal v(n) to the divider 440.

The weighting signal calculator 360 calculates the response signal $s_w(n)$ for each sub-frame as in Equation (19) by using the output parameter (LSP parameter) of the spectral parameter calculator 200 and the output parameter (linear prediction coefficient $\alpha_1$) of the spectral parameter quantizer 210, and outputs the calculated response signal to the response signal calculator 240.

Equation (19):

$$s_w(n) = v(n) - \sum_{i=1}^{P}\alpha_i v(n-i) + \sum_{i=1}^{P}\alpha_i\gamma^i p(n-i) + \sum_{i=1}^{P}\alpha'_i\gamma^i s_w(n-i)$$

The divider 440 executes the band division to sub-bands with respect to the drive excitation signal v(n) outputted from the weighting signal calculator 360, and outputs the past excitation signals $v_1(n)$ to $v_U(n)$ corresponding to the sub-bands to the adaptive codebooks $\mathbf{300}_1$ to $\mathbf{300}_U$.

The description so far has concerned the first embodiment of the signal coder according to the present invention.

Figure 2:
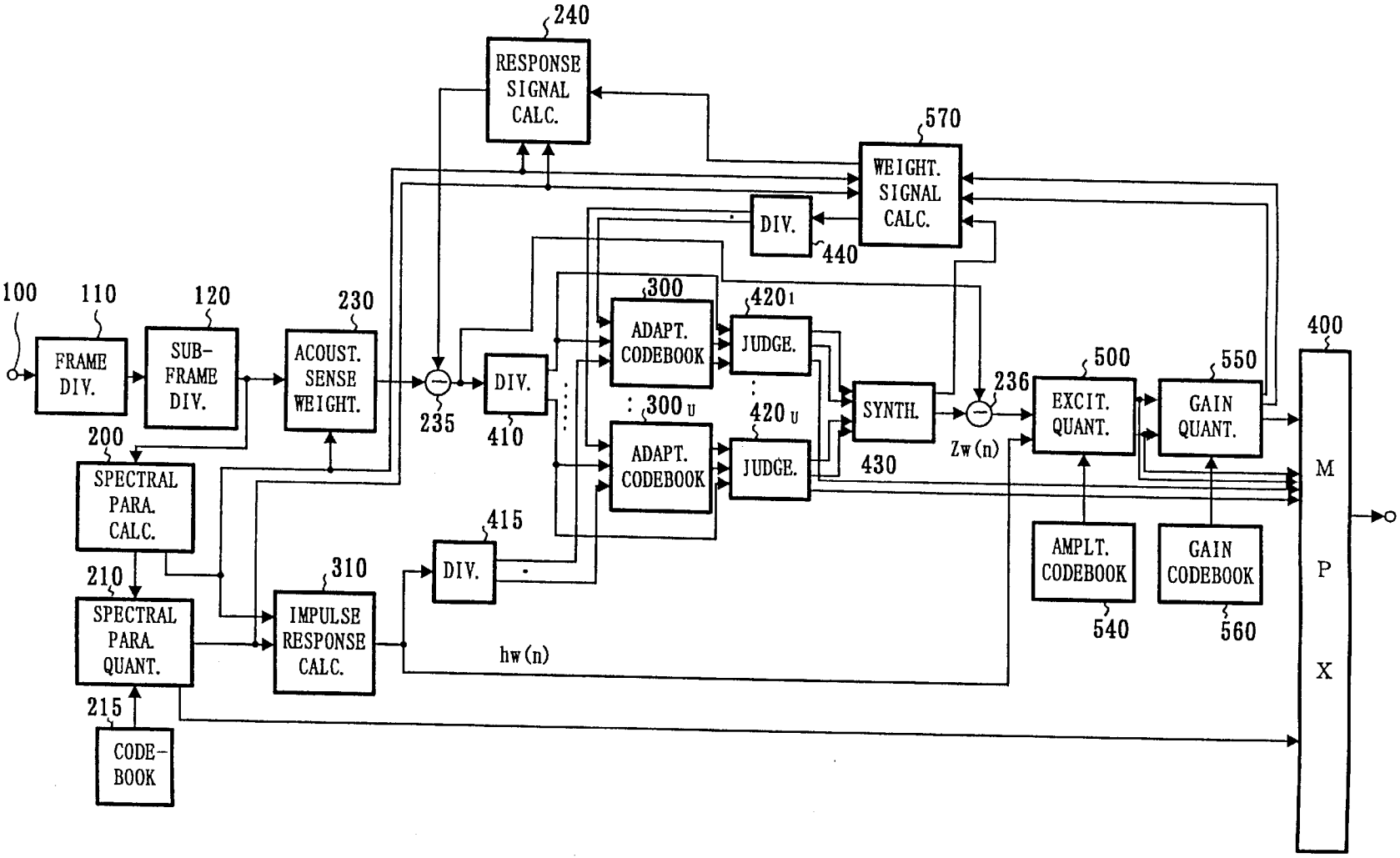
FIG. 2 is a block diagram showing a second embodiment of the signal coder according to the present invention.

FIG. 2 is a block diagram showing a second embodiment of the signal coder according to the present invention. The second embodiment of the signal coder is different from the first embodiment of the signal coder shown in FIG. 1 in an excitation quantizer 500, an amplitude codebook 540, a gain quantizer 550, a gain codebook 560, and a weighting signal calculator 570. The other component circuits are designated by like reference numerals and not described.

Figure 3:
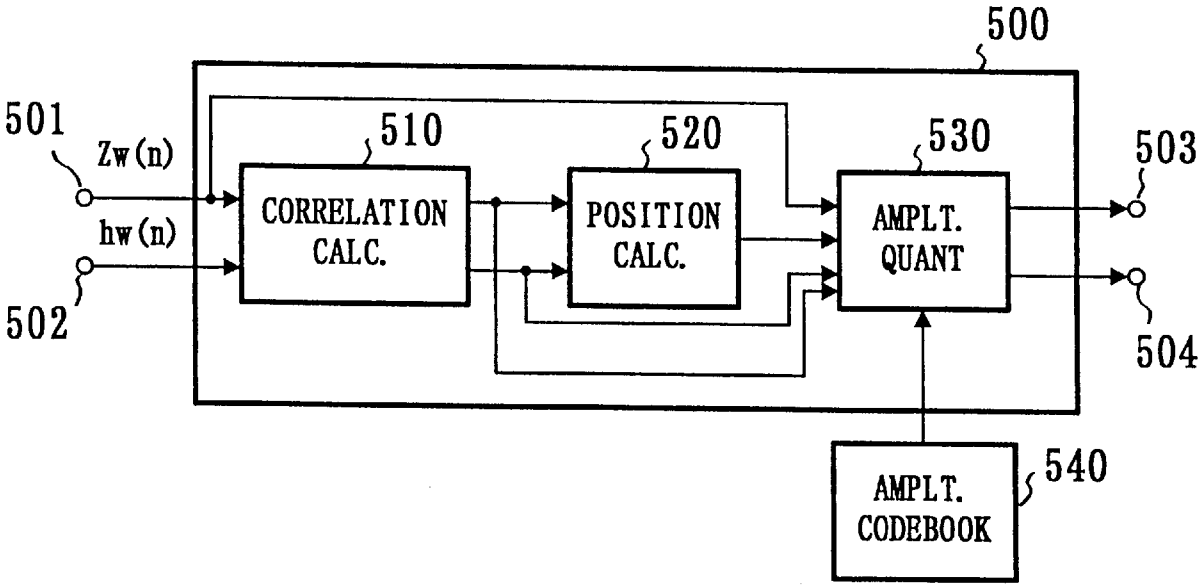
FIG. 3 is a block diagram of the excitation quantizer 500 in FIG. 1.

Referring to FIG. 3, the excitation quantizer 500 includes a correlation calculator 510, a position calculator 520, and an amplitude quantizer 530.

The operation of the second embodiment of the signal coder having the above construction will now be described in connection with differences from the case of the first embodiment of the signal coder.

The excitation quantizer 500 calculates the positions and amplitudes of M non-zero amplitude pulses in a pulse train.

Specifically, as shown in FIG. 3, the correlation coefficient calculator 510, receiving, from terminals 501 and 502, the subtracted result $z_w(n)$ of the subtractor 236 and the impulse response $h_w(n)$ of the impulse response calculator 310, calculates two different correlation coefficients $\phi(n)$ and $\phi(p, q)$ as in Equations (20) and (21), and outputs these correlation coefficients to the position calculator 520 and amplitude quantizer 530.

Equation (20):

$$\phi(n) = \sum_{i=n}^{N-1} z_w(i)h_w(i-n), \quad n = 0, \ldots, N-1$$

Equation (21):

$$\phi(p, q) = \sum_{n=\max(p,q)}^{N-1} h_w(n-p)h_w(n-q), \quad p, q = 0, \ldots, N-1$$

The position calculator 520 calculates the positions of a predetermined number M of non-zero amplitude pulses. Specifically, the position calculator 520 obtains for each pulse a pulse position which maximizes an evaluation value D represented by Equation (22) among predetermined position candidates as in Literature 3.

Table 1 shows an example of position candidates in the case of a sub-frame length of N=40 and a pulse number of M=5.

TABLE 1

| |
|---|
| 0,5,10,15,20,25,30,35 |
| 1,6,11,16,21,26,31,36 |
| 2,7,12,17,22,27,32,37 |
| 3,8,13,18,23,28,33,38 |
| 4,9,14,19,24,29,34,39 |

The position calculator 520 selects a position which maximizes Equation (22) for each pulse by checking the position candidates.

Equation (22):

$$D = \frac{C_k^2}{E_k}$$

In Equation (22), $C_k$ and $E_k$ are given by Equations (23) and (24), respectively.

Equation (23):

$$C_k = \sum_{k=1}^{M} \mathrm{sgn}(k)\phi(m_k)$$

Equation (24):

$$E_k = \sum_{k=1}^{M} \mathrm{sgn}(k)^2\phi(m_k, m_k) + 2\sum_{k=1}^{M-1}\sum_{i=k-l-1}^{M} \mathrm{sgn}(k)\mathrm{sgn}(i)\phi(m_k, m_i)$$

In Equations (23) and (24), $m_k$ represents the position of a k-th pulse, and sgn(k) represents the polarity of the k-th pulse.

The position calculator 520 outputs the position data of the M pulses to the amplitude quantizer 530.

The amplitude quantizer 530 amplifies the amplitudes of the pulses by using the amplitude codebook 530. Specifically, the amplitude quantizer 530 selects the amplitude codevectors which maximize the evaluation value given by Equation (25).

Equation (25):

$$C_j^2/E_j$$

In Equation (25), $C_j$ and $E_i$ are given by Equations (26) and (27)

Equation (26):

$$C_j = \sum_{k=1}^{M} g'_{kj}\phi(m_k)$$

Equation (27):

$$E_j = \sum_{k=1}^{M} g'^2_{kj}\phi(m_k, m_k) + 2\sum_{k=1}^{M-1}\sum_{i=k+1}^{M} g'_{kj}g'_{ij}\phi(m_k, m_i)$$

In Equations (26) and (27), $g'_{kj}$ is the amplitude of the k-th pulse in the j-th amplitude codevector.

It is possible that the amplitude codevector 540 for the pulse amplitude quantization is preliminarily studied using the speech signal and stored. For a codebook study method, reference may be had to, for instance, Linde et al, "An algorithm for vector quantization design", IEEE Trans. Commun., pp-84–95, 1980 (Literature 12).

The amplitude quantizer 530 outputs the amplitude codevector index and position data from terminals 503 and 504.

The gain quantizer 550 quantizes the pulse gain using the gain codebook 560. Specifically, the gain quantizer 550 selects a gain codevector which minimizes the distortion $D_t$ in Equation (28), and outputs the index of the selected gain codevector to the multiplexer 400.

Equation (28):

$$D_t = \sum_{n=0}^{N-1}\left[z_w(n) - G_t'\sum_{k=1}^{N} g_{kj}'h_w(n-m_k)\right]^2$$

The weighting signal calculator 570 receives the pitch delay index, the quantized gain index, the index of the amplitude codebook 540, and the gain codevector index, reads out a codevector corresponding to the read-out indexes, and derives the drive excitation signal v(n) as in Equation (29).

Equation (29):

$$v(n)=g(n)+G'_i g'_{kj}h_w(n=m_k)$$

The weighting signal calculator 570 outputs the drive excitation signal v(n) to the divider 440.

The weighting signal calculator 570 calculates the response signal $s_w(n)$ for each sub-frame as in Equation (30) by using the output parameter (LSP parameter) of the spectral parameter calculator 200 and the output parameter (linear prediction coefficient $\alpha_i'$ of the spectral parameter quantizer 210, and outputs the calculated response signal to the response signal calculator 240.

Equation (30):

$$s_w(n) = v(n) - \sum_{i=1}^{P} \alpha_i v(n-i) + \sum_{i=1}^{P} \alpha_i\gamma^i p(n-i) + \sum_{i=1}^{P} \alpha_i'\gamma^i s_w(n-i)$$

Figure 4:
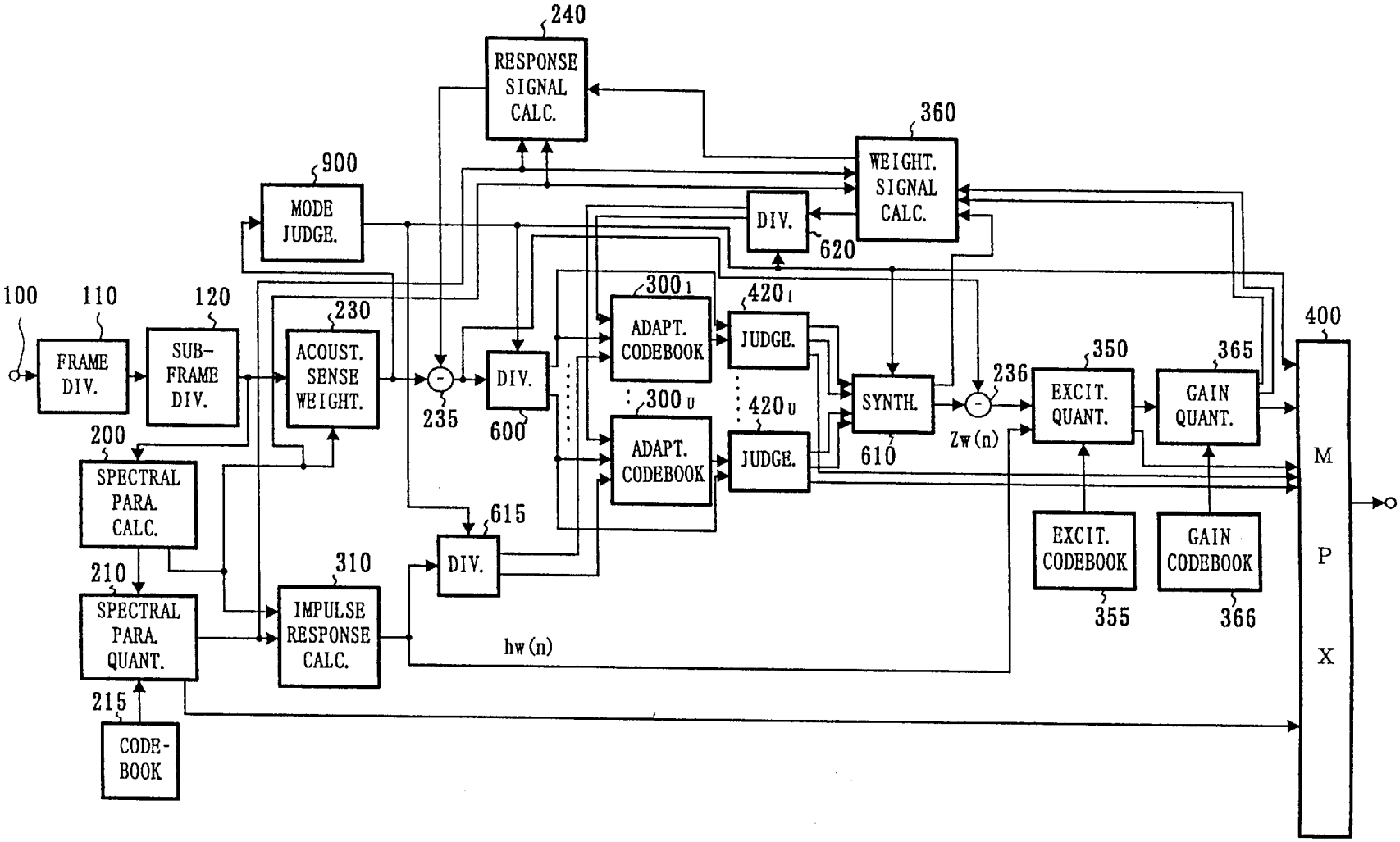
FIG. 4 is a block diagram showing a third embodiment of the signal coder according to the present invention.

FIG. 4 is a block diagram showing a third embodiment of the signal coder according to the present invention. FIG. 4 is different from FIG. 1 in dividers 600, 615 and 620, synthesizer 610 and a mode judging circuit 900.

The operation of the third embodiment of the signal coder having the above construction will now be described mainly in connection to its differences from the case of the first embodiment of the signal coder.

The mode judging circuit 900 receives the acoustical sense weighted signal $X_w(n)$ for each frame from the heating sense weighting circuit 230, and outputs mode data to the dividers 600, 615 and 620, the synthesizer 610 and the multiplexer 400.

The mode judgment is executed at this time by using a feature quantity of the current frame. As the feature quantity, the frame mean pitch prediction gain G is used. The frame mean pitch prediction gain G is calculated by using Equation (31), for instance.

Equation (31):

$$G = 10\log_{10}\left[1/L \sum_{i=1}^{L} (P_i/E_i)\right]$$

In Equation (31), L is the number of sub-frames in one frame, and $P_i$ and $E_i$ are the speech power in the i-th sub-frame in Equation (32) and the pitch prediction error power in Equation (33), respectively.

Equation (32):

$$P_i = \sum_{n=0}^{N-1} x_{wi}^2(n)$$

Equation (33):

$$E_i = P_i - \left[\sum_{n=0}^{N-1} x_{wi}(n)x_{wi}(n-T')\right]^2 / \left[\sum_{n=0}^{N-1} x_{wi}^2(n-T')\right]$$

In Equation (33), T' is the optimum delay for maximizing the frame mean pitch prediction gain G.

The mode judging circuit 900 classifies the frame mean pitch prediction gain G into a plurality of, for instance four, different modes by comparison to a plurality of different predetermined threshold values.

The dividers 600, 615 and 620 and synthesizer 610 receive mode data, and in a predetermined mode they perform the same process as in the first embodiment of the signal coder as shown in FIG. 1 by dividing signal into a plurality of sub-bands. In the other modes, they do not perform the signal division into the sub-bands or synthesis of signal.

Figure 5:
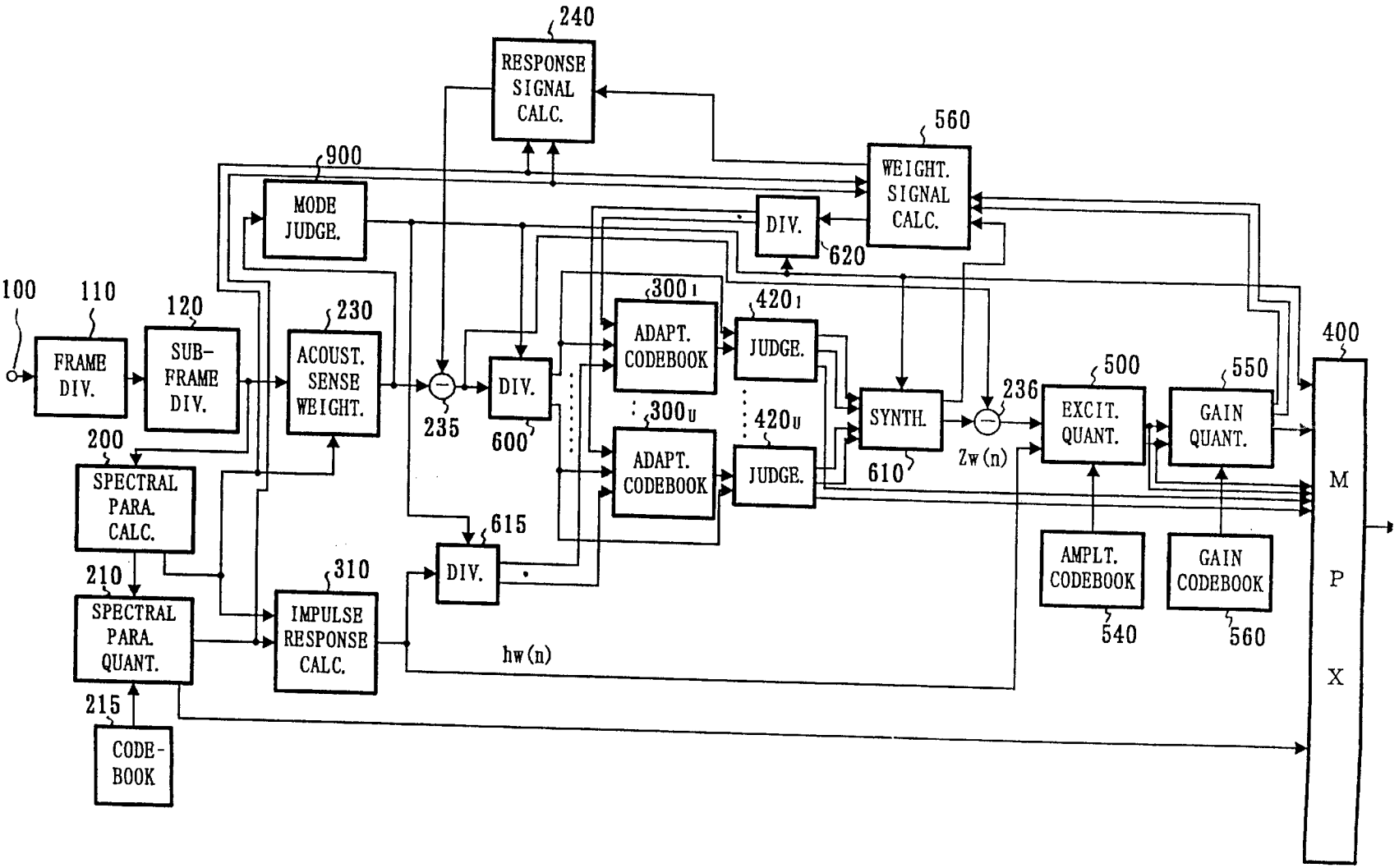
FIG. 5 is a block diagram showing a fourth embodiment of the signal coder according to the present invention.

FIG. 5 is a block diagram showing a fourth embodiment of the signal coder according to the present invention. This embodiment of the signal coder is obtained by adding the mode judging circuit 900 shown in FIG. 4 to the second embodiment of the signal coder shown in FIG. 2. Like parts are thus designated by like reference numerals, and are not described.

Figure 6:
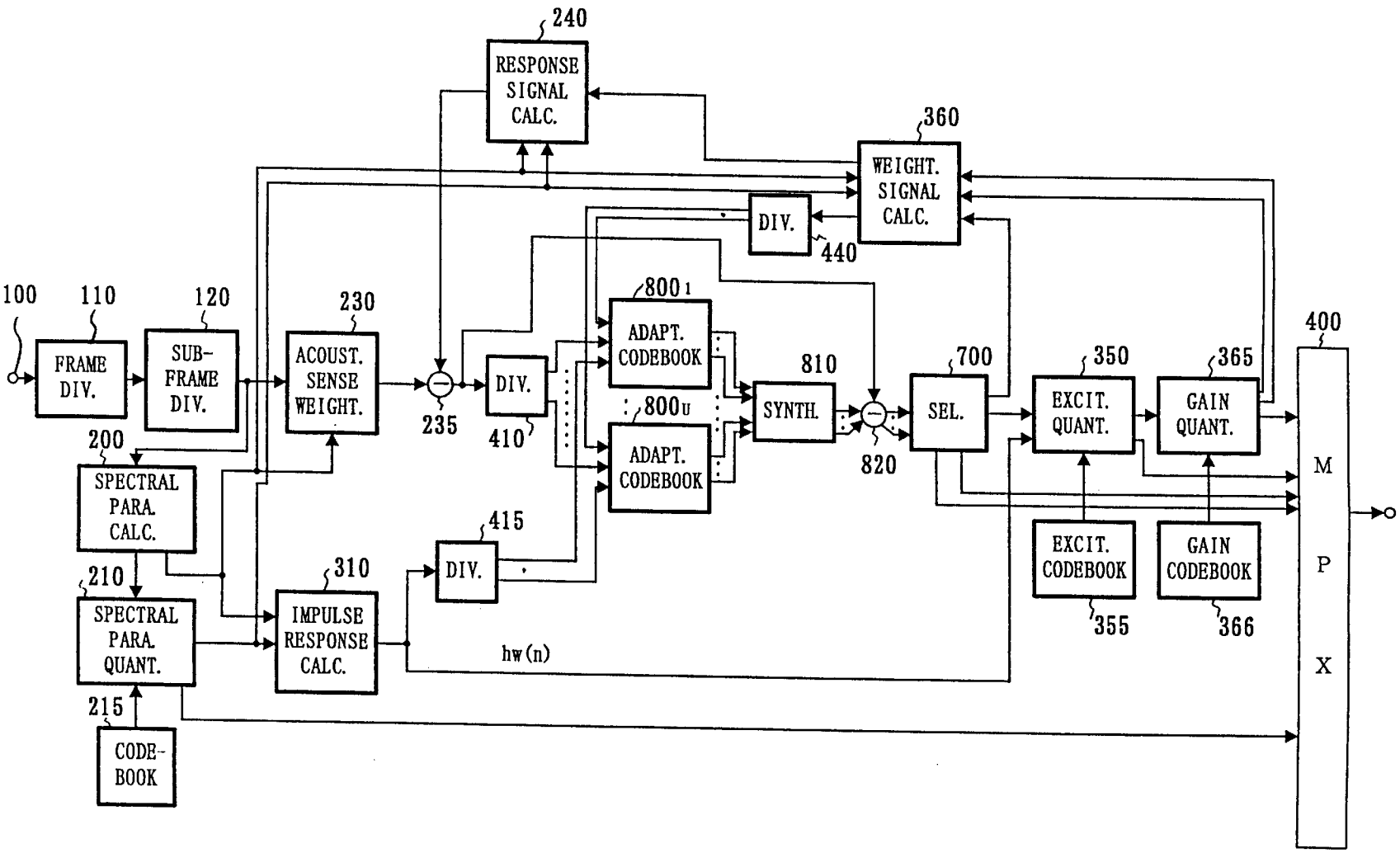
FIG. 6 is a block diagram showing a fifth embodiment of the signal coder according to the present invention.

FIG. 6 is a block diagram showing a fifth embodiment of the signal coder according to the present invention. This embodiment of the signal coder is different from the first embodiment of the signal coder shown in FIG. 1 in a selector 700, an adaptive codebook circuits $\mathbf{800}_1$ to $\mathbf{800}_U$, a synthesizer 810 and a subtractor 820. These components will now be described.

The adaptive codebook circuits $\mathbf{800}_1$ to $\mathbf{800}_v$ are operable in the same way, and only the adaptive codebook $\mathbf{800}_1$ will be described. The adaptive codebook $\mathbf{800}_1$ calculates a plurality of pitch cycles in the order of minimizing the distortion $D_{T1}$ in Equation (7), and quantizes these pitch cycles by calculating the pitch gain $\beta_1$ using Equation (9). The adaptive codebook circuit $\mathbf{800}_1$ also calculates the pitch prediction signal $q_{w1}(n)$ for each of the plurality of pitch cycles as in Equation (10), and outputs the calculated result to the synthesizer 810.

The synthesizer 810 derives a full bands prediction signal $q_w(n)_k$ for each of the combinations of all of the candidates from the adaptive codebook circuits $\mathbf{800}_1$ to $\mathbf{800}_U$, and outputs these full range prediction signals to the subtractor 820.

The subtractor 820 subtracts the subtracted result $X'_w(n)$ from each prediction signal $q_w(n)_k$, and outputs the difference to the selector 700.

The selector 700 calculates a predicted error power $E_k$ in Equation (34) for each of a plurality of subtracted result $z_w(n)_k$ outputted from the subtractor 820.

Equation (34):

$$E_k = \sum_{n=0}^{N-1} z_w(n)_k^2$$

The selector 700 selects a combination which corresponds to a minimum of the predicted error power $E_k$ in Equation (34). At this time, the selector 700 outputs the minimum predicted error signal $z_w(n)_k$ to the excitation quantizer 350, and outputs the corresponding full bands excitation signal $g(n)_K$ to the weighting signal calculator 360. The selector 700 outputs an index representing the pitch cycle of the selected candidate and an index representing the quantized pitch gain to the multiplexer 400.

Figure 7:
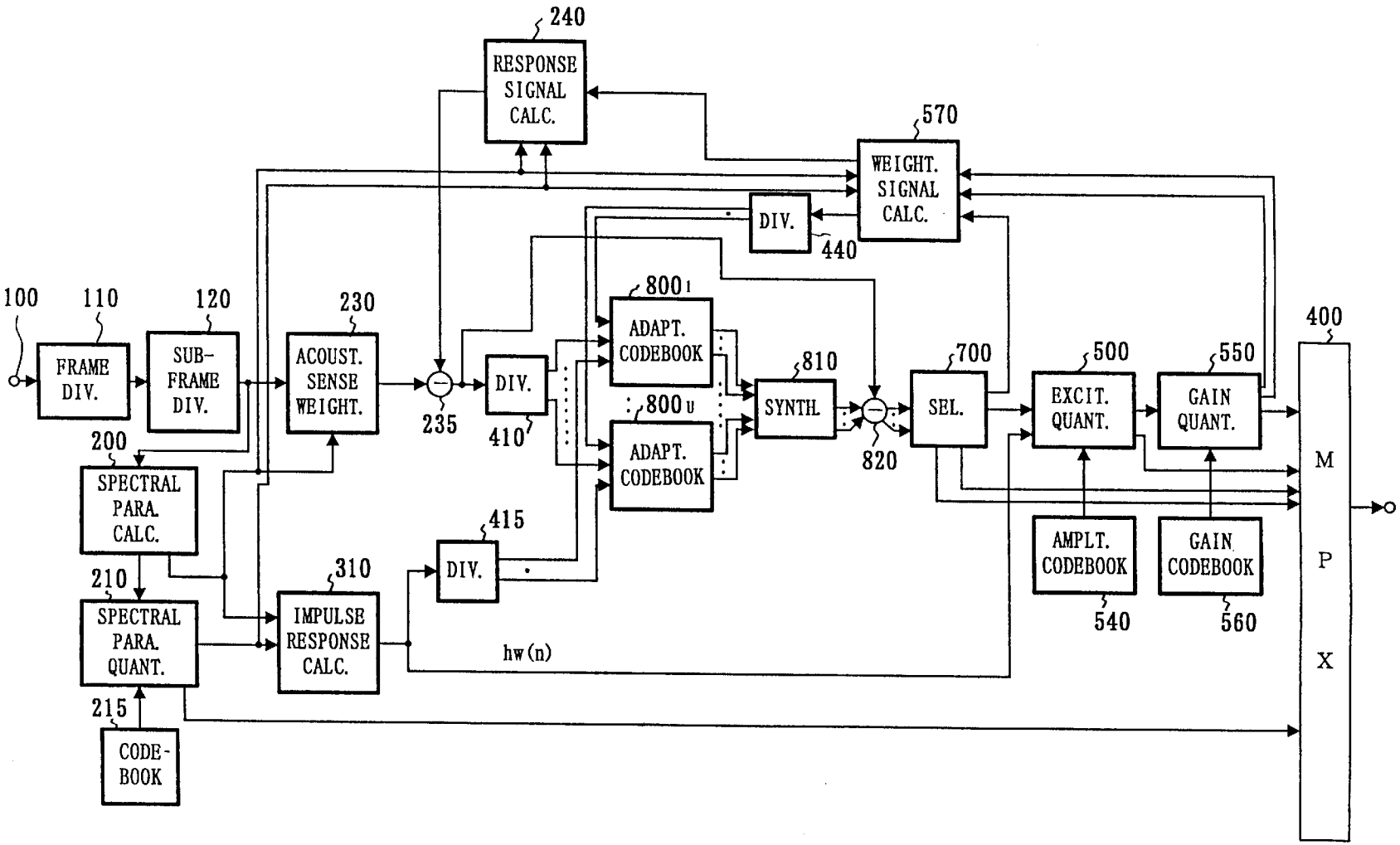
FIG. 7 is a block diagram showing a sixth embodiment of the signal coder according to the present invention.

FIG. 7 is a block diagram showing a sixth embodiment of the signal coder according to the present invention. In this embodiment of the signal coder, an excitation quantizer 500, an amplitude codebook 540, a gain quantizer 550, a gain codebook 560 and a weighting signal calculator 570 are those used in the second embodiment of the signal code shown in FIG. 2, and they are not described in detail.

Figure 8:
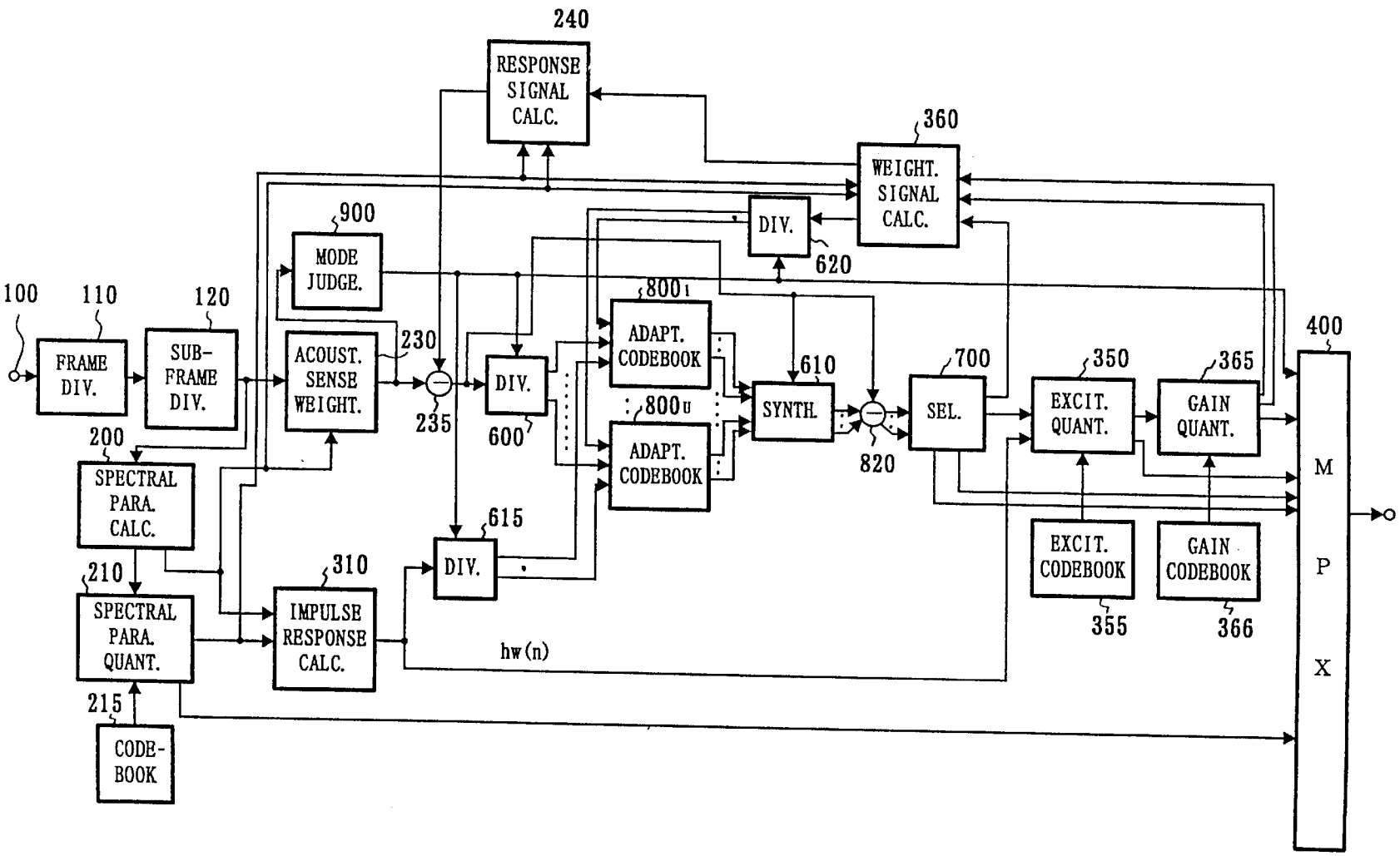
FIG. 8 is a block diagram showing a seventh embodiment of the signal coder according to the present invention.

FIG. 8 is a block diagram showing a seventh embodiment of the signal coder according to the present invention. This embodiment of the signal coder is obtained by combining the mode judging circuit 900, dividers 600, 615 and 620 and synthesizer 610 shown in FIG. 4 to the fifth embodiment of the signal coder shown in FIG. 7. In a predetermined mode, this embodiment performs the same operation as in the fifth embodiment of the signal coder shown in FIG. 6.

Figure 9:
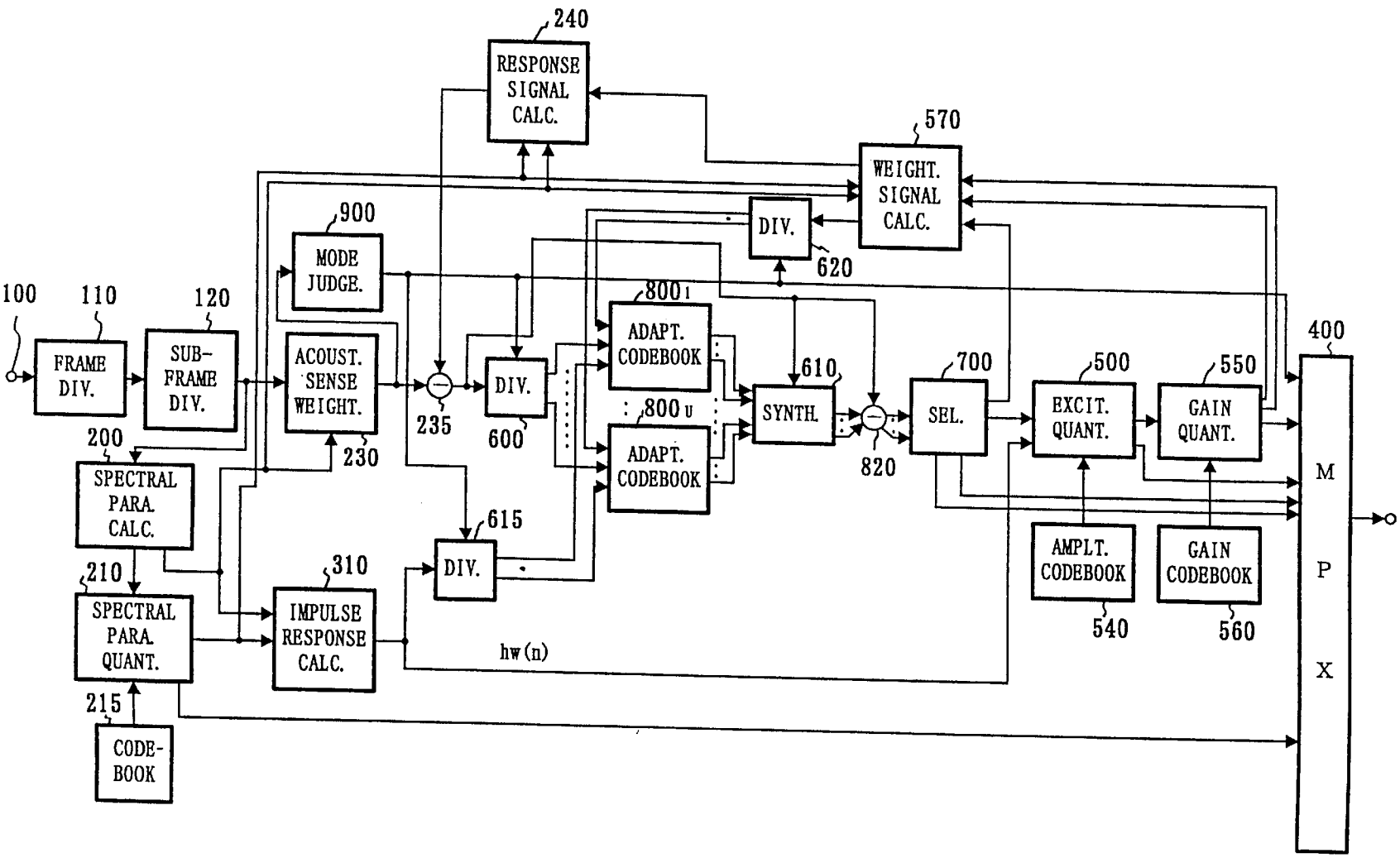
FIG. 9 is a block diagram showing an eighth embodiment of the signal coder according to the present invention.

FIG. 9 is a block diagram showing an eighth embodiment of the signal coder according to the present invention. In this embodiment of the signal coder, the excitation quantizer 500, amplitude codebook 540, gain quantizer 550, gain codebook 560 and weighting signal calculator 570 shown in FIG. 2 are used in the seventh embodiment of the signal coder shown in FIG. 8, and these components are not described in detail.

The embodiments described above are by no means limitative, and can be modified variously.

For example, it is possible to permit switching of the excitation quantizer and the gain codebook by using the mode data.

When using the excitation codebook, it is possible to permit selection of a plurality of codebooks in the order of smaller values of the distortion $D_t$ given by Equation (14) and selection of a combination of an excitation codevector and a gain codevector which minimizes the distortion $D_t$ shown in Equation (17) while quantizing gain in the gain quantizer.

Where the excitation is represented by a pulse train, when quantizing the pulse amplitudes, a plurality of pulse position sets may be obtained, and a combination which minimizes $E_k$ in Equation (25) may be obtained by retrieving the amplitude codebook for each pulse position set. As a further alternative, a plurality of such combinations may be outputted to the gain quantizer for selecting a combination of position, amplitude codevector and gain codevector which minimizes the distortion $D_t$ in Equation (28) while the gain is quantized.

It is further possible to collectively gain quantize a plurality of adaptive codebook gains obtained in the respective sub-ranges.

As has been described in the foregoing, according to the present invention the input signal is divided into a plurality of sub-bands, the pitch prediction judgment is executed by obtaining the pitch data in at least one of the sub-bands, and a full band signal is synthesized for quantizing the excitation signal of the input signal. Thus, with signals containing a plurality of different pitches such as speech signals produced by a plurality of speakers in a conference or the like and also musical signals, adaptive pitch selection is made for each sub-band, thus improving the sound quality compared to the prior art system. In addition, since the excitation signal is obtained over the full band, it is possible to obtain efficient quantization without waste of data.

According to the present invention, the mode of signal is judged by extracting a feature quantity from the input signal, and the processing described above is performed only in a predetermined mode. It is thus possible to obtain very useful effects.

Moreover, according to the present invention, in addition to the above effects, the excitation signal is expressed as a pulse train consisting of M zero-amplitude pulses, and it is thus possible to obtain better sound quality with relatively less retrieving and computational efforts.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A signal coder comprising:

a spectral parameter calculator for obtaining a spectral parameter from an input signal and quantizing the spectral parameter thus obtained;

a divider for dividing the input signal into a plurality of frequency sub-bands;

a pitch calculator for obtaining pitch data in at least one of the frequency sub-bands and obtaining a pitch prediction signal;

a judging unit for obtaining the pitch prediction signal in at least one of the frequency sub-bands and executing pitch prediction judgment; and an excitation quantizer for synthesizing the pitch prediction signal, subtracting the obtained pitch prediction signal from the input signal to obtain an excitation signal, and quantizing the obtained excitation signal.

2. The signal coder according to claim 1, wherein the excitation signal of the input signal is quantized by expressing it as a plurality of non-zero amplitude pulses.

3. A signal coder comprising:

a spectral parameter calculator for obtaining a spectral parameter from an input signal and quantizing the spectral parameter thus obtained;

a mode judging unit for judging the mode of the input signal by extracting a feature quantity therefrom;

a divider for dividing the input signal into a plurality of frequency sub-bands in a predetermined mode;

a pitch calculator for obtaining pitch data in at least one of the frequency sub-bands and obtaining a pitch prediction signal;

a judging unit for making pitch prediction judgment using the pitch prediction signal in at least one of the frequency sub-bands; and an excitation quantizer operable in a predetermined mode to synthesize the pitch prediction signal, obtaining an excitation signal by subtracting the synthesized pitch prediction signal from the input signal, and quantizing the obtained excitation signal.

4. The signal coder according to claim 3, wherein the excitation signal of the input signal is quantized by expressing it as a plurality of non-zero amplitude pulses.

5. A signal coder comprising:

a spectral parameter calculator for obtaining a spectral parameter from an input signal and quantizing the spectral parameter thus obtained;

a divider for dividing the input signal into a plurality of frequency sub-bands;

a pitch calculator for obtaining a plurality of pitch data candidates in at least one of the frequency sub-bands and obtaining a pitch prediction signal for each pitch data candidate;

a selector for synthesizing the pitch prediction signal for a combination of pitch data candidates and selecting the best pitch data by using the error signal between the input signal and the pitch prediction signal; and an excitation quantizer for quantizing the error signal.

6. The signal coder according to claim 5, wherein the error signal is quantized by using a plurality of non-zero amplitude pulses.

7. A signal coder comprising:

a spectral parameter calculator for obtaining a spectral parameter from an input signal and quantizing the spectral parameter thus obtained;

a mode judging unit for judging the mode of the input signal by extracting a feature quantity therefrom;

a divider for dividing the input signal into a plurality of frequency sub-bands in a predetermined mode;

a pitch calculator for obtaining a plurality of pitch data candidates in at least one of the frequency sub-bands and obtaining a pitch prediction signal for each pitch data candidate;

a selector operable in a predetermined mode to synthesize the pitch prediction signal for a combination of pitch data candidates and selecting the best pitch data by using the error signal between the input signal and the pitch prediction signal; and an excitation quantizer for quantizing the error signal.

8. The signal coder according to claim 7, wherein the error signal is quantized by expressing it using a plurality of non-zero amplitude pulses.

* * * * *